US005800242A

United States Patent [19]

Clokey

[11] Patent Number: 5,800,242

[45] Date of Patent: Sep. 1, 1998

[54] REINFORCED ARTICLES OF ELASTOMERIC MATERIAL

[75] Inventor: Arthur C. Clokey, San Raphael, Calif.

[73] Assignee: Prema Toy Company, Inc., San Raphael, Calif.

[21] Appl. No.: 812,066

[22] Filed: Dec. 23, 1996

[51] Int. Cl.[6] ..... A63H 3/04

[52] U.S. Cl. ..... 446/374; 446/337

[58] Field of Search ..... 446/321, 327, 446/329, 337, 338, 339, 370, 373, 374

[56] References Cited

U.S. PATENT DOCUMENTS 2,109,422 2/1938 Haughton ..... 446/374

2,184,639 12/1939 Exline ..... 446/339

4,196,541 4/1980 Clokey ..... 446/374

FOREIGN PATENT DOCUMENTS 2252057 7/1992 United Kingdom ..... 446/374

*Primary Examiner*—Robert A. Hafer

*Assistant Examiner*—Jeffrey D. Carlson

*Attorney, Agent, or Firm*—Finnegan, Henderson, Farabow, Garrett & Dunner, L.L.P.

[57] ABSTRACT

The present invention relates to improvements in articles useful as desk ornaments or toys which are in the form of caricatures having faces and arms made of elastomeric materials and reinforced with wire in a manner such that the article can be manipulated to selectively achieve a wide variety of moods or expressions.

10 Claims, 3 Drawing Sheets

REINFORCED ARTICLES OF ELASTOMERIC MATERIAL

CROSS REFERENCE TO RELATED APPLICATIONS, IF ANY

None

BACKGROUND OF THE INVENTION AND PRIOR ART

The present invention relates to the art of manufacture of articles such as facial likenesses or caricatures made of elastomeric resilient materials such as rubber or to plastics which can be molded. These caricatures are particularly useful as novelty desk ornaments or toys which can be rapidly manipulated to display a particular mood or message—e.g. good mood, bad mood, etc.

The art of casting or molding of articles made from resilient rubber or plastic materials is well developed and facial likenesses of known or fictitious characters can of course be made therefrom. My prior U.S. Pat. No. 4,196,541 issued Apr. 8, 1980 discloses deformable caricatures in which various facial expressions are attainable. The present invention is an improvement thereon in which additional moods can be expressed by manipulating the facial expressions and, optionally, by also manipulating arms and hands of the character to cover the ears, eyes, mouth, etc. to achieve a wide variety of moods or expressions as desired.

Additional prior art known to applicant comprises U.S. Pat. No. 2,109,422, Haughton; U.S. Pat. No. 3,624,691, Robson et al; and U.S. Pat. No. 3,061,880, Weisbach.

It is an objective of the present invention to provide a facial likeness or caricature in which the facial expression can be selectively changed and, optionally, parts of the face can be covered by hands of the character if desired to attain a wide variety of expressions. More specifically, the present invention is directed to the attainment of additional facial and body expressions by an improved forehead and upper mouth structure and manipulatable arms which interact with the facial portion of such caricatures.

SUMMARY OF THE INVENTION

The present invention accordingly provides an article of elastomeric material having a facial portion in the form of a facial likeness or a caricature capable of assuming a variety of different facial expressions, said article having a mouth with upper and lower lips, a nose, eye and eyebrow portions and deformable, preferably shielded, reinforcement embedded in the elastomeric material in said facial portion, said reinforcement being capable of being manually manipulated to hold the elastomeric material in the selected facial expression, said reinforcement comprising a first reinforcing member extending substantially around the periphery of the facial portion of the article, a second reinforcing member generally in the form of an open ended rectangular loop having its spaced end portions extending transversely across the facial portion of the article located behind the eyes, said second reinforcing member being affixed to said first reinforcing member and a third reinforcing member in said facial portion extending transversely thereof above said mouth, at least one of said second and third reinforcing members having an upwardly extending deformable bow therein.

In its preferred form, the invention further provides an article of elastomeric material which includes a pair of arms and hands integrally formed from said elastomeric material, said arms being of length sufficient to enable said arms to be deformed such that one or both hands may cover or be placed proximate selected portions of the face.

DESCRIPTION OF THE PREFERRED EMBODIMENT

Articles according to the present invention can be made of any suitable nontoxic resilient rubber or plastic material which can be cast in a mold. Non-toxicity of the plastic material is not an essential characteristic but is highly desirable since articles constructed according to the present invention will frequently be used as desk decorations or as toy items for children thus non-toxicity of each material is highly desirable.

Figure 1:
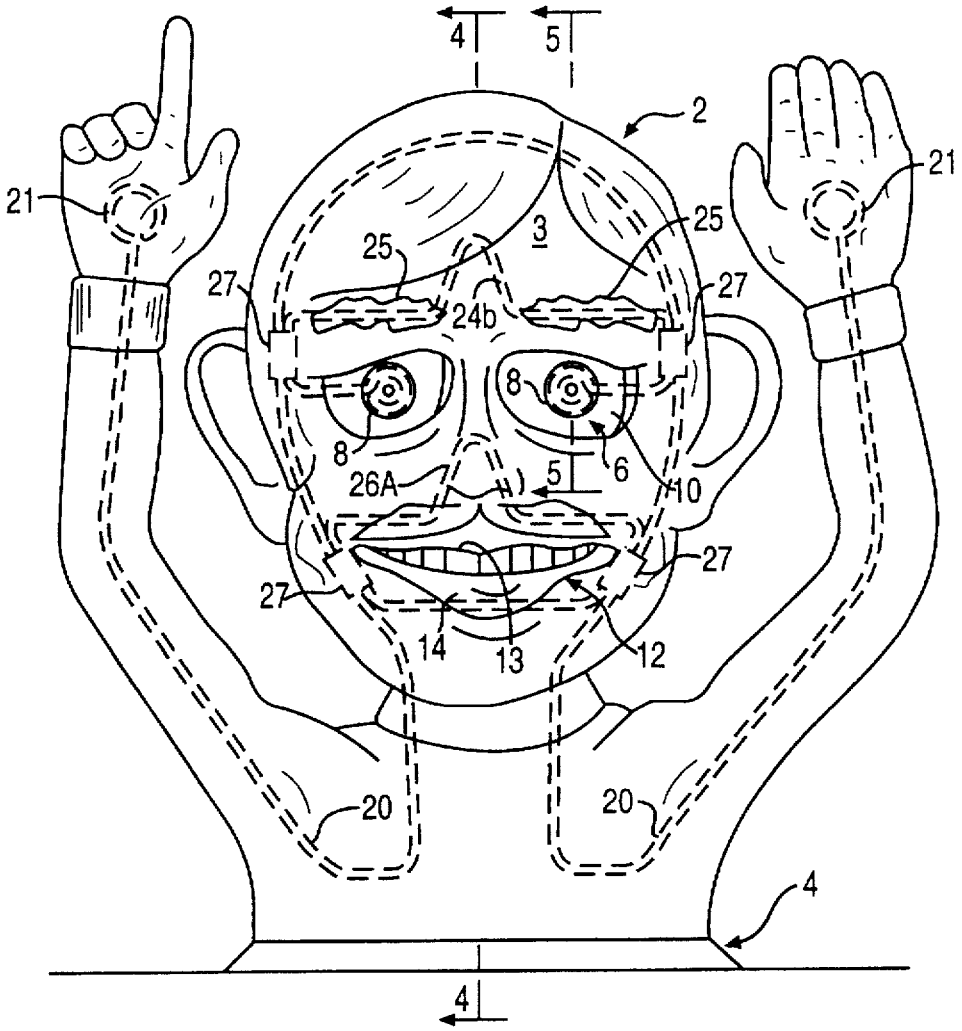
FIG. 1 comprises a front view of a caricature constructed in accordance with the preferred embodiment and shows the external features thereof.

FIG. 1 shows a facial caricature 2 including all of the usual facial features and having a face 3 and a base 4. It will of course be appreciated that any shape of the lower portion or body of the article can be used such as by substituting a torso or feet in place of the base 4. As can be seen from FIGS. 1 and 5, the eyes 6 comprise generally cylindrical or conical projections 8 which are inset into the face 3 in a recessed area 10. This construction enables the eyes 6 to be protruded forwardly from the face 3 to the dashed line position shown in FIGS. 4 an 5 and by manipulation from the rear of the article as will be described subsequently in greater detail.

Figure 4:
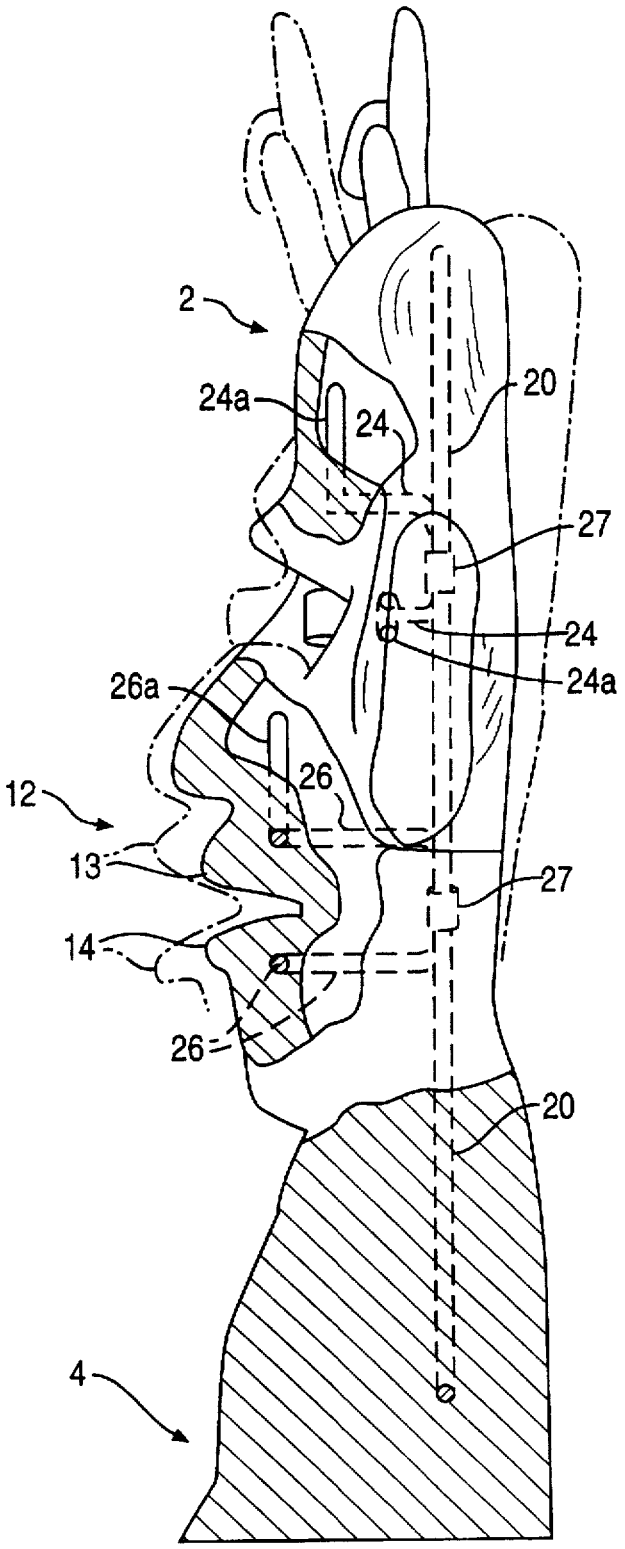
FIG. 4 is a profile or side view, partly in section, of the caricature shown in FIG. 1.

As also seen in FIG. 1, the mouth 12 comprises separate upper and lower lips 13, 14 which extend forwardly and which are generally parallel to each other. Reference is here made to FIG. 4 which is the profile view, partially in section, showing the spacing of the lips 13, 14 from each other. Also shown in dashed line position in FIG. 4 is the location to which the eyes 6 and lips 13, 14 can be forwardly protruded if desired.

Figure 2:
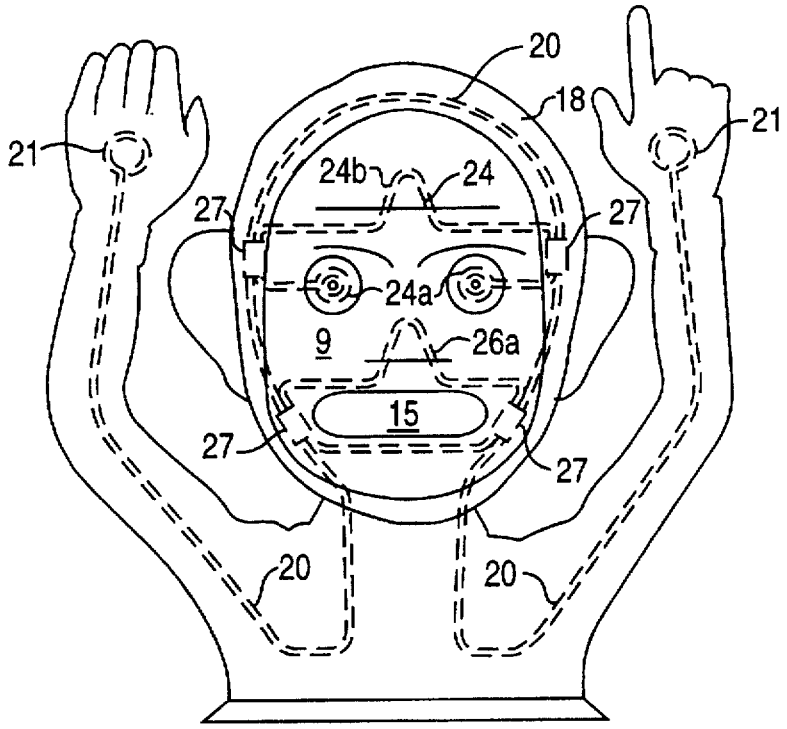
FIG. 2. comprises a rear view showing built-up areas in which the resilient rubber or plastic material is thickened and reinforced.

As seen in FIG. 2, the rear portion of the face portion of the article includes a generally concave cavity. The facial portion has a thickened periphery 18 extending therearound for reception of a peripheral wire reinforcement 20 which extends through elastomeric arms integrally formed with the head and base portions of the character. The arms and hands may be manipulated such that either or both hands may cover selected parts of the face such as the eyes, mouth, nose or ears to create a wide variety of expressions or moods as desired. One of the hands preferably has a single pointing index finger which can be positioned to point as desired and the other hand is preferably configured such that the thumb is slightly spaced from the index finger such that the hand can hold articles such as a coin between the thumb and index finger on the palm when the palm is positioned upwardly.

The peripheral reinforcement 20 includes two end portions each having a suitably configured anchor 21 which is embedded in the hands as shown. A second reinforcement wire 24, which may be in the form of a generally rectangular loop having spaced ends 24*a*, is located in the facial portion of the article as shown to provide reinforcing at the area adjacent the eyebrows 25 and in the area behind the eyes 6 as shown. Wire 24 has an upwardly extending bow or bight 24*b* between and above the eyebrows to enable the user to manipulate the face to pinch the eyebrows 25 close together if desired to form a frown or expression of thought by displaying a furrowed brow or to separate and raise the brows to express surprise. A third reinforcing wire 26 is located as shown to provide transverse reinforcement for the upper lip 13 and the area adjacent the lower lip 14. Similar to wire 24, the lip reinforcement wire 26 has an upwardly extending bow or bight 26*a* which can be pinched together to bring the upper lip toward the nose to express, e.g., smell or disgust.

Wires 20, 24 and 26 are affixed together where shown by metallic clips 27.

All of the reinforcing wires 20, 24, 26 are made of a deformable wire which preferably comprises a stainless steel annealed alloy which is corrosion free. Such wire can be readily deformed and will hold its selected shape. Preferably a non-toxic coating or shield of high density polypropylene will be used on the wire which is embedded in the resilient material of which the article is made.

Again referring to FIG. 2, it can be seen that the areas in which the wires 24, 26 respectively are embedded are constructed to be somewhat thicker or more massive than the remainder of the article in order to provide an adequate thickness of material surrounding each reinforcing wire. Also, each eye cone 8 is mounted on a boss or wall 9 of relatively thin material so that depression from the rear of the face of the boss or wall 9 readily causes the eye cones 8 to be protruded forwardly. Similarly, a boss 15 extends in the cavity immediately behind the mouth 12 such that depression of the boss 15 will cause a change in configuration of the mouth 12. It has been found that the thin wall 9 surrounding each eye cone 8 permits flexibility of the eyes and variety of expression not heretofore attainable.

Figure 3:
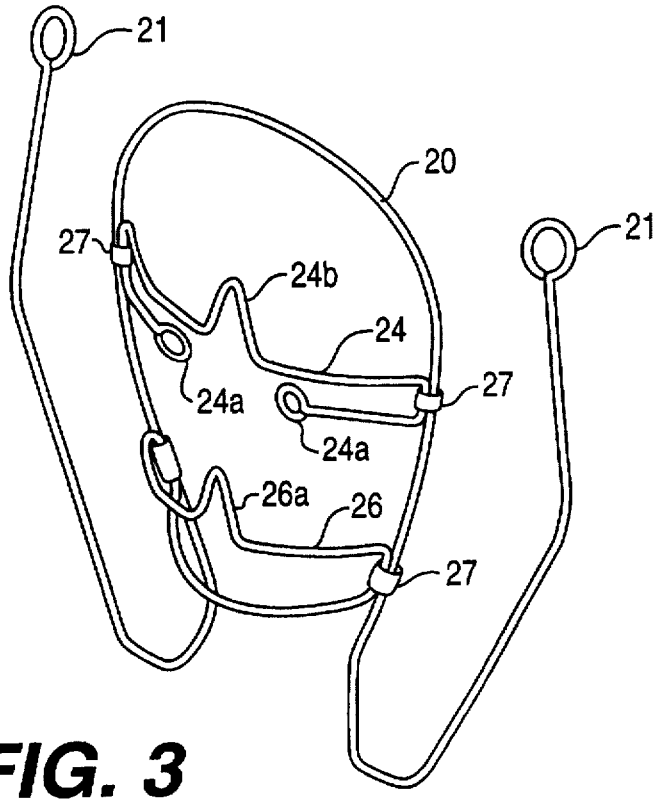
FIG. 3 is a perspective view showing the reinforcement.

For clarity in illustration, the reinforcement is shown separately in FIG. 3. While three separate pieces of shielded reinforcing wire 20, 24, 26 have been shown it will be appreciated by persons skilled in the art that different patterns of reinforcement may be more appropriate for different usages. In the preferred embodiment, the reinforcing wires are welded or otherwise affixed together as by metal clips 27 before they are embedded in the resilient material during the casting or molding process. Thus, the reinforcing wires will not become detached from each other but will remain capable of assuming whichever position is desired.

Figure 5:
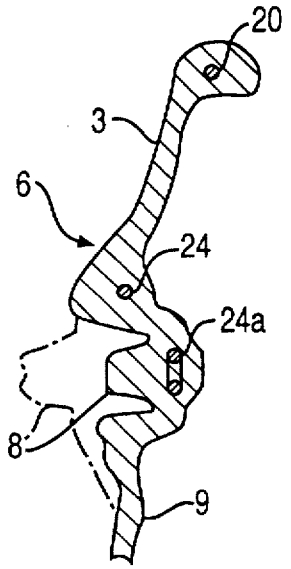
FIG. 5 is a cross section of the eye cavity or cone taken along lines 5—5 in FIG. 1.

It has been found that the construction of the open ended loop wire 24 with spaced ends 24*a* located behind each eye 6 and embedded as shown in conical projections 8 enables the character to assume a variety of eye configurations including, but not limited to, a wink or squint (as by locating one end 24*a* of wire loop 24 higher or lower than the other) and "eyes forward" positions as seen in dashed line position in FIG. 5 or "eyes rear" position as shown in solid line position in FIG. 5. Preferably the ends 24*a* of loop of wire 23 are each bent into a closed eye so as to avoid sharp ends of wire embedded in the elastomeric material.

The type of elastomeric material, thickness thereof and type of wire must be selected together to ensure that the finished article can be readily manipulated by hand to selectively alter the facial expressions. Thus the wire must be stiff enough to hold the elastomeric material in the desired shape yet the wire must be flexible enough so that it can be easily bent and will retain its position.

By way of example only, articles have been constructed in which the size of the facial portion is approximately 4" in width and 4½" in height. The elastomeric material is about 3/16" thick in most portions except those having shielded reinforcing wire therein wherein a minimum of about ⅛" cover exists on all sides of the wire. The wire employed was an 18 gauge stainless steel having a polyethylene shield coating thereon. Such articles can easily be manipulated to assume and retain desired facial expressions of infinite variety. The facial portions of the articles can be made to smile, frown, laugh, squint, stare or any combination of the above. The lips can spread apart or pressed close together and the eyebrow can be pushed downwardly or upwardly to register anger or surprise, etc.

While the foregoing constitutes a complete description of the preferred embodiment, it will be appreciated by persons skilled in the art that modifications can be made from the preferred embodiment and the scope of protection is to be evaluated solely with respect to the attached claims.

I claim:

1. An article of elastomeric material having a facial portion in the form of a facial likeness or a caricature capable of assuming a variety of different facial expressions, said article having a mouth with upper and lower lips, a nose, eye and eyebrow portions and deformable reinforcement embedded in the elastomeric material in said facial portion, said reinforcement being capable of being manually manipulated to hold the elastomeric material in the selected facial expression, said reinforcement comprising a first reinforcing member extending substantially around the periphery of the facial portion of the article, a second reinforcing member generally in the form of an open ended rectangular loop having its spaced end portions extending transversely across the facial portion of the article located behind the eyes, said second reinforcing member being affixed by connections to said first reinforcing member, and a third reinforcing member in said facial portion extending transversely thereof above said mouth, at least one of said second and third reinforcing members having an upwardly extending deformable bow in a portion of said at least one of said second and said third reinforcing members which extends continuously transversely across said facial portion from said connections.

2. An article of elastomeric material according to claim 1, wherein said bow is centrally located in a continuous transversely extending portion of said second reinforcing member which provides reinforcement extending in the area of said facial portion transversely thereof substantially above said eyebrows.

3. An article of elastomeric material according to claim 1, wherein said bow is centrally located in a continuous transversely extending portion of said third reinforcing member above said mouth and proximate the lower portion of said nose.

4. An article of elastomeric material according to claim 1, wherein each of said second and third reinforcing members has an upwardly extending deformable bow therein, said bow in said second reinforcing member being located in a continuous transversely extending portion substantially above said eyebrows and said bow in said third reinforcing member being located in a continuous transversely extending portion above said mouth and proximate the lower portion of said nose.

5. An article of elastomeric material according to claim 1, further comprising a pair of arms and hands integrally formed from said elastomeric material, said arms being of length sufficient to enable said arms to be deformed such that one or both hands may cover or be placed proximate selected portions of said face, said first reinforcing member extending through said arms and having enlargements at the ends thereof to prevent the ends of said first reinforcing member from puncturing said elastomeric material proximate the hands.

6. An article of elastomeric material according to claim 4 wherein said second reinforcing member is affixed to said first reinforcing member at locations adjacent narrow ends of said rectangular loop.

7. An article of elastomeric material according to claim 1 wherein said eye portions each include a generally conical projection mounted on a surrounding thin wall of flexible elastomeric material, said conical projections each having one end of said spaced ends of said second reinforcing member disposed therein whereby said conical projections may be moved forwardly and rearwardly and laterally with respect to the other portions of said facial portion and will remain in the selected location due to the elastic memory of said second reinforcing member.

8. An article of elastomeric material according to claim 7 wherein said third reinforcing member is affixed at the ends thereof to said first reinforcing member.

9. An article of elastomeric material to claim 1 wherein said reinforcement comprises a wire having a non-toxic plastic coating thereon.

10. An article of elastomeric material according to claim 1 wherein said spaced ends of said second reinforcing member are provided with enlargements to prevent the ends of said second reinforcing member from puncturing the elastomeric material proximate the eyes.

* * * * *